US011105182B2

(12) United States Patent
Petrowsky et al.

(10) Patent No.: US 11,105,182 B2
(45) Date of Patent: Aug. 31, 2021

(54) COMPACT ROTATING JACKING APPARATUS, FOR CEMENTING CASING IN A BORE PROVIDING ROTATING AND RECIPROCAL STROKE MOTION TO CASING FROM SURFACE, AND OTHER WELL TASKS

(71) Applicant: PIPE SLIDERS LTD., Red Deer (CA)

(72) Inventors: Conrad Petrowsky, Red Deer (CA); Jeremy Hayter, Red Deer (CA)

(73) Assignee: PIPE SLIDERS LTD., Red Deer (CA)

( * ) Notice: Subject to any disclaimer, the term of this patent is extended or adjusted under 35 U.S.C. 154(b) by 82 days.

(21) Appl. No.: 16/297,261

(22) Filed: Mar. 8, 2019

(65) Prior Publication Data

US 2020/0284120 A1 Sep. 10, 2020

(51) Int. Cl.

| | |
|---|---|
| ***E21B 19/086*** | (2006.01) |
| ***E21B 33/14*** | (2006.01) |
| ***E21B 19/07*** | (2006.01) |
| ***E21B 19/08*** | (2006.01) |

(52) U.S. Cl.

CPC ..... *E21B 33/14* (2013.01); *E21B 19/07* (2013.01); *E21B 19/08* (2013.01)

(58) Field of Classification Search

CPC ..... E21B 19/08; E21B 19/086; E21B 33/14

See application file for complete search history.

(56) References Cited

U.S. PATENT DOCUMENTS

| | | | | |
|---|---|---|---|---|
| 2,595,401 | A * | 5/1952 | Moon | E21B 3/02 173/152 |
| 3,096,075 | A * | 7/1963 | Brown | E21B 19/00 254/29 R |
| 3,557,875 | A | 1/1971 | Solum et al. | |
| 3,722,603 | A * | 3/1973 | Brown | E21B 19/10 173/159 |
| 4,476,936 | A * | 10/1984 | Boyadjieff | E21B 19/00 166/383 |
| 4,479,547 | A * | 10/1984 | Boyadjieff | E21B 19/07 166/383 |
| 4,869,323 | A | 9/1989 | Stagg | |
| 6,209,633 | B1 * | 4/2001 | Haynes | E21B 19/086 166/378 |
| 7,117,948 | B2 * | 10/2006 | Mazzella | E21B 19/00 166/379 |
| 7,481,280 | B2 | 1/2009 | Benge et al. | |
| 8,863,846 | B2 * | 10/2014 | Overstreet | E21B 19/086 166/338 |
| 9,945,191 | B2 | 4/2018 | Petrowsky et al. | |
| 10,494,896 | B1 * | 12/2019 | Youngquist, Jr. | E21B 43/10 |
| 2016/0032667 | A1 | 2/2016 | Petrowsky et al. | |

* cited by examiner

*Primary Examiner* — Kenneth L Thompson

(74) *Attorney, Agent, or Firm* — Bennett Jones LLP

(57) ABSTRACT

A compact rotary surface jack with a driven rotary hanger flange on an upper travelling plate of the jack is provided by the invention; the jack is preferably a horseshoe jack. Capabilities to work on the well such as rotating and reciprocating while cementing casing in place in the well, or setting or unsetting in-hole devices such as packers, anchors and bridge plugs (etc.) by providing low speed (1-6 rpm) rotational force and short (1-6 feet) linear vertical forces to tubulars in a well to which the device is attached, are enabled.

6 Claims, 6 Drawing Sheets

COMPACT ROTATING JACKING APPARATUS, FOR CEMENTING CASING IN A BORE PROVIDING ROTATING AND RECIPROCAL STROKE MOTION TO CASING FROM SURFACE, AND OTHER WELL TASKS

FIELD OF INVENTION

Workover or completion operations on wells for the oil and gas production industry is assisted by new compact rotating jack invention and cementing and other processes.

BACKGROUND OF THE INVENTION AND PRIOR ART

There exist in the prior art examples of jack systems in the field of oil and gas production wells to assist in injection and removal of tubulars in a wellbore for example to assist in workover or completion tasks on an existing, already drilled well. For example, U.S. Pat. No. 9,945,191 discloses a horse-shoe-shaped jack for mounting on a well at or near the wellhead, installable laterally while tubulars extend from the well, to provide linear 'in-out' forces to the tubulars to inject or remove them from the well's bore. That horse-shoe jack system permitted installation and removal from a well in a simplified fashion from a lateral position without needing to strip the jack system over the tubular for installation.

This jack system provides linear forces to the well's tubulars. Those linear forces are not typically useful in the cementing process for cementing casing into a wellbore, except for injecting the casing tubulars into the bore prior to commencement of injection of cement through the casing and back up the annulus between the casing and the wellbore's inner surface.

In another process for cementing casing in a well's bore, it has been found that rotating the casing during the flowing of cement into the annulus assists in both centralizing the casing tubing in the well, and providing an improved bond between the casing and the cement, and the bore surface and the cement, with fewer voids and better distribution of cement. An example of this is discussed in an article "New Cementing Method Uses Pipe Movement to Maximize Displacement" by Calvin Holt, Nilesh Lahoti and Vince Fortier of Tesco Corp, published in 2013, Innovating While Drilling magazine, March/April issue <web location>. The article discusses use of a top-drive system to rotate casing while running the casing into a drilled wellbore to where the casing tubing is landed at the well's bottom, and then rotating the casing tubing with the top-drive of the drilling rig, while pumping cement through the top-drive and thereby cementing the casing in the wellbore. Rotation in this case during cementing starts at about 60 rpm, and is backed down to about 45 rpm when torque forces on the casing tubing exceed a threshold. Rotation is continued by the top-drive until the cementing is completed, and then a displacement or wiper plug is injected into the casing's bore by salt water under pressure, pushing cement in the casing's inner bore past its lower end and into the annulus of the wellbore. At that stage, cementing is completed and the cement is allowed to set. The required elements for this process comprise a top-drive through which cement may be pumped while the casing tubing is rotated by the top-drive system and under its control. Additionally, a CRT or casing running tool, which is a component of the top-drive rig, is required to push the casing into the wellbore, particularly to force the casing against friction forces between the well's inner wall and the casing's outer surface where the well is non-vertical (e.g. horizontal, or aligned where the casing will be forced by gravity against the lower wall of the wellbore). This casing drive system (CDS) automates linear (in-out) forces applied to the casing tubing by the top-drive system. Also required is a wireless torque turn sub (WTTS) to monitor and control torque or turning forces and rotational speeds applied to the casing tubing by the CDS. A cement head or swivel is required to be fitted to the top-drive above the top of the casing tubing string. Torque rings or centralizers may be fitted to the casing tubing's exterior. Some knowledge of the torque capacity, tension capacity, and compression characteristics of the casing tubing are also beneficial to assist in decisions about how much rotational force to apply during cementing. Problems arise if rotation stops during cementing as friction forces from the cement and wellbore on the casing tubing's external wall will act against attempts to resume rotation.

SUMMARY OF THE INVENTION

In an embodiment, where an existing well is to be worked over, for instance to re-line an old casing tubing in a wellbore with new casing to be injected into the old casing's conduit or bore and then cemented in place with cement in the annulus between the new casing's external surface and the old casing's internal surface, it is advantageous to utilize conventional workover rigs to insert the casing tubing and land it into the old casing, and then to temporarily install the compact rotating jack system of this invention on the wellhead to rotate the new casing as cement is being injected. There is no need for large vertical lift distances by the jack, as the casing is already landed and is not being removed but rather is being installed permanently. Cementing takes place via a cement head or swivel and the rotating jack provides rotational movement to the casing during cementing, preferably at slow rotational speeds such as around 4-6 rpm. Sometimes, it is necessary that the rotational movement stops during the cementing process, in which cases friction forces of the cement acting on the outer surface of the casing make resumption of rotation very difficult without using excessive torque forces to break the frictional bond. In those instances, a short reciprocating in-out linear lift movement can be applied by the compact jack to the casing string to break the frictional bonds and permit rotation to resume without imposing large torque loads on the tubing. When cementing operations are completed, the compact jack can be removed from the well and completion rig and taken away by a small trailer.

Having a local ability to rotate tubulars and move them linearly a short distance is also useful to perform other tasks on a well, for example: it is possible to set and un-set bottom hole tools that require rotational and/or stroke (linear) forces, with or without pressure control in the well—examples include packers, anchors, bridge plugs and etc.; similarly it permits swaging out casing impairments where similar forces and motions are required to be applied in the well.

A compact rotary surface jack with a driven rotary hanger flange on an upper travelling plate of the jack is provided by the invention, the jack comprising: a) a first subassembly for providing vertical reciprocal motion to a casing tubular, first comprising: i.) a lower jack assembly for mounting to a well-head attached to a blowout preventer or annular of a well bore, ii) at least one jack powered to both extend and retract thus lengthening and shortening a distance between the lower jack assembly and an upper end of the jack, iii) a middle jack plate attached to the jack between the lower jack assembly and the upper end of the jack, iv) an upper travelling jack plate attached to the upper end of the jack; with a second subassembly for providing rotational motion to the a casing or other tubular, operatively attached to the upper travelling plate, the second subassembly comprising: a) a rotary drive fixed to the travelling plate with an internal passageway through which the casing tubular can fit, with a concentric circular driven portion of the rotary drive which is rotatable in relation to the jack on a plane normal (perpendicular) to the direction of the jack's extension-retraction motion, but affixed to the rotary drive and jack to be driven to move vertically as the travelling plate is driven vertically by the jack; b) the circular driven portion having a central passageway through which the casing tubular can fit; c) a rotary adapter plate attached to the driven portion of the rotary drive, the rotary adapter plate having a central passageway through which the casing tubular can fit, the rotary adapter plate being removably affixed to the driven portion of the rotary drive; d) at least one hanger flange attached to the rotary adapter plate having a central passageway through which the casing tubular can fit, with means for the hanger flange to be removably attached to and hold the casing tubular and transmit rotating movement of the rotary drive and linear movement of the jack to the casing tubular.

In another embodiment, the same rotating and hanger means but where the jack is a compact horseshoe jack for manipulating tubing or casing or associated fittings into or out of a well, comprising: a) a first mount for connecting the jack either directly or indirectly to a wellhead associated with the well, the mount having a U-shaped passage through which the tubing or casing and any associated fittings fit; b) at least one linear jack with two ends, a first end of which is fixed to an upper side of the first mount; c) a travelling second mount with a U-shaped passage into and through which tubing or casing and any associated fittings fit, fixed to a second end of the at least one linear jack to which the rotary adapter plate and rotary drive are affixed; d) means for powering linear extension and retraction of the jack to alter the distance between the first and second mounts while the tubing or casing and any associated fittings are within the U-shaped passages of the mounts, said passages being in substantial vertical alignment and in working alignment with the wellhead and associated well bore.

In a preferred embodiment, bracing means are attached to the compact rotating jack's middle jack plate, and the bracing means including: chains or tension-bearing cables between the middle jack plate and an element of well-head equipment to assist in resisting rotational movement of the jack during operation; and/or one or more solid extension arm elements between the middle jack plate and an element of wellhead equipment, to assist in resisting rotational movement of the jack and stabilize the rotating head in spatial relation to the well.

In another embodiment of the rotating jacking apparatus, the at least one hanger flange attached to the rotary adapter plate comprises: a hanger flange for attachment to the casing or tubing to hold the casing or tubing from rotation relative to the flange when the apparatus operates to provide rotational motion to the tubing; and another hanger flange for attachment to the casing or tubing to hold the casing or tubing from linear movement relative to the flange when the jack of the apparatus operates to provide linear jacked movement to the tubing via movement of the flange.

In operation, while cementing a casing tubular into a wellbore, after the casing tubing has been injected into the wellbore, either during or after cement injection through the casing and into the annulus between the casing tubular's outer surface and the inner surface of the wellbore, performing the following steps: with a compact rotary surface jack of this invention, moving the casing tubing a short distance in a linear direction into and out of the wellbore to break frictional forces between the cement and the outer wall of the casing tubing, and then, with the compact rotary surface jack, rotating the casing tubular in the wellbore in contact with the cement until a satisfactory cement/tubular bond is achieved and a suitable centralized location of the tubular in the wellbore is achieved, and then, disengaging and removing the compact rotary surface jack, optionally leaving the casing tubing suspended by a hanger at the wellhead, or without suspending the casing tubing by a hanger, but suspended independently by the cement's bond.

DETAILED DESCRIPTION

Figure 1:
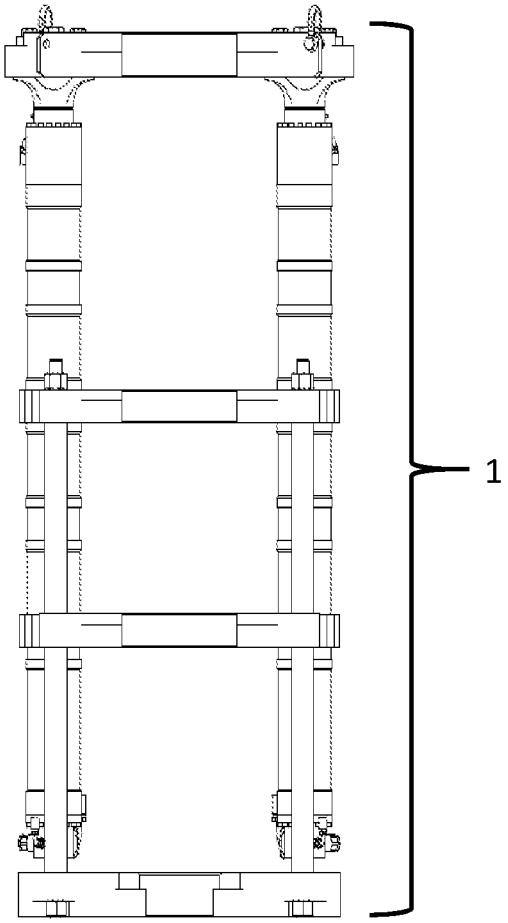
PRIOR ART Fig. 1
FIG. 1 is a side elevation drawing of a PRIOR ART compact horseshoe jack from U.S. Pat. No. 9,945,191
Figure 2:
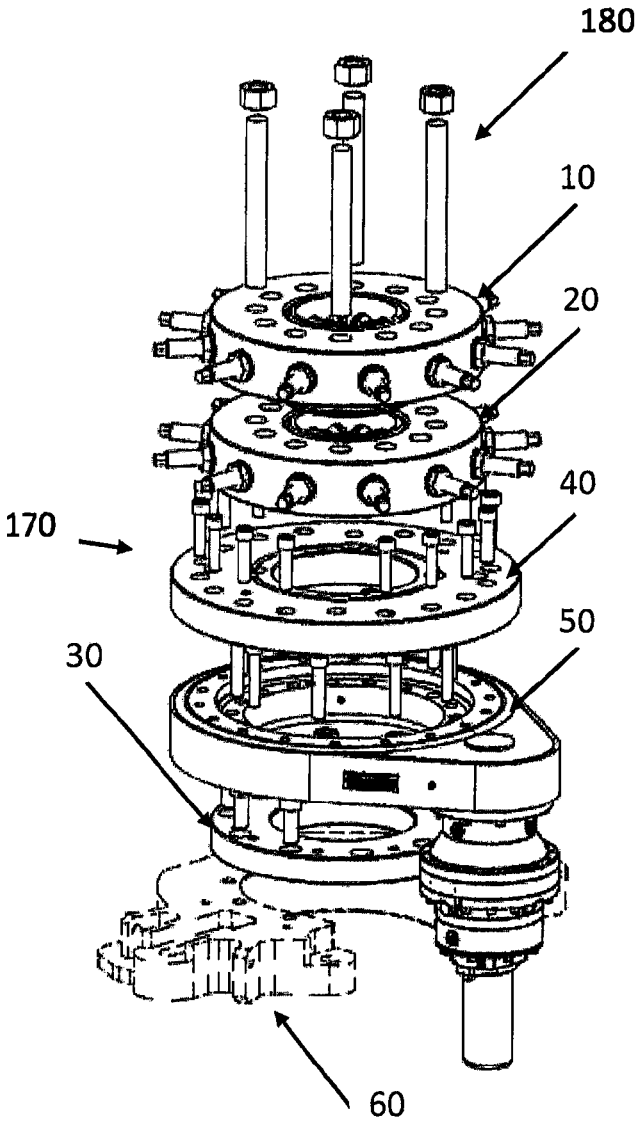
FIG. 2 is an exploded view of the active rotary drive and pipe hanger flange system of this invention, unattached to the vertical jacking system
Figure 3A:
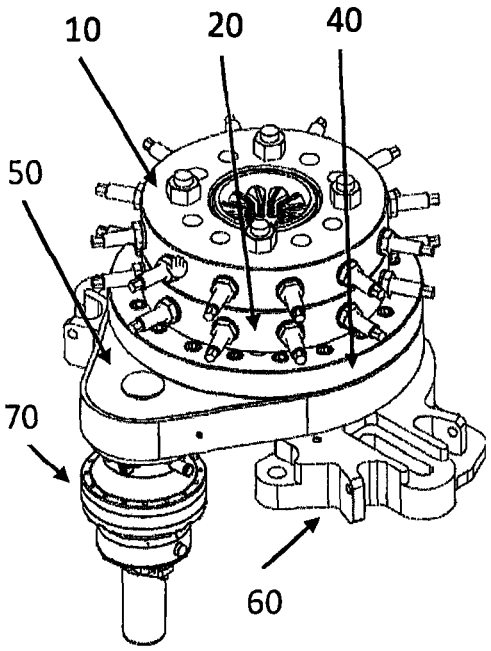
FIGS. 3*a* and 3*b* are a perspective drawing and a cross-sectional view of the travelling plate with rotary drive and hanger flanges of the system, unattached to the balance of the jack system
Figure 3B:
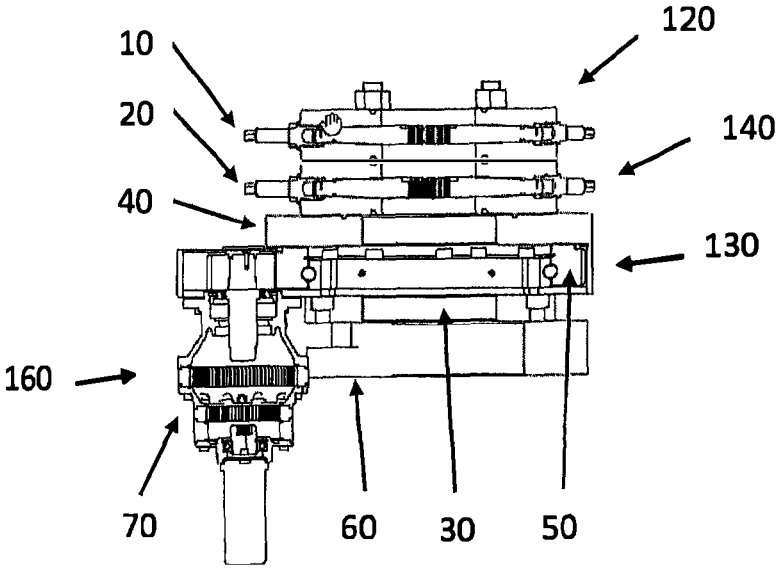
Figure 4:
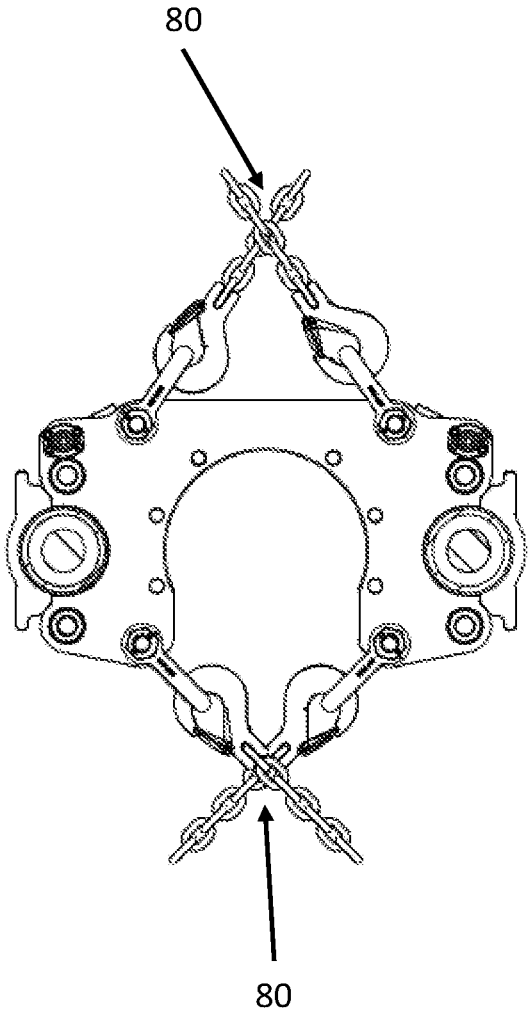
FIG. 4 is a drawing showing chain restraints attached to a plate of the jacking system for attachment to a workover rig to restrict rotation of the compact jack elements during rotating operations on the casing tubing during cementing.
Figure 5:
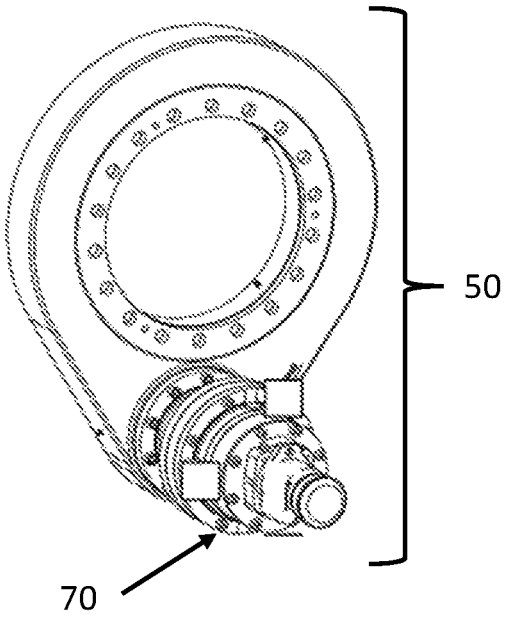
FIG. 5 is a perspective elevation of a slew-drive/planetary gearbox and hydraulic motor rotary drive system which is a component of the system shown in FIG. 3.
Figure 6:
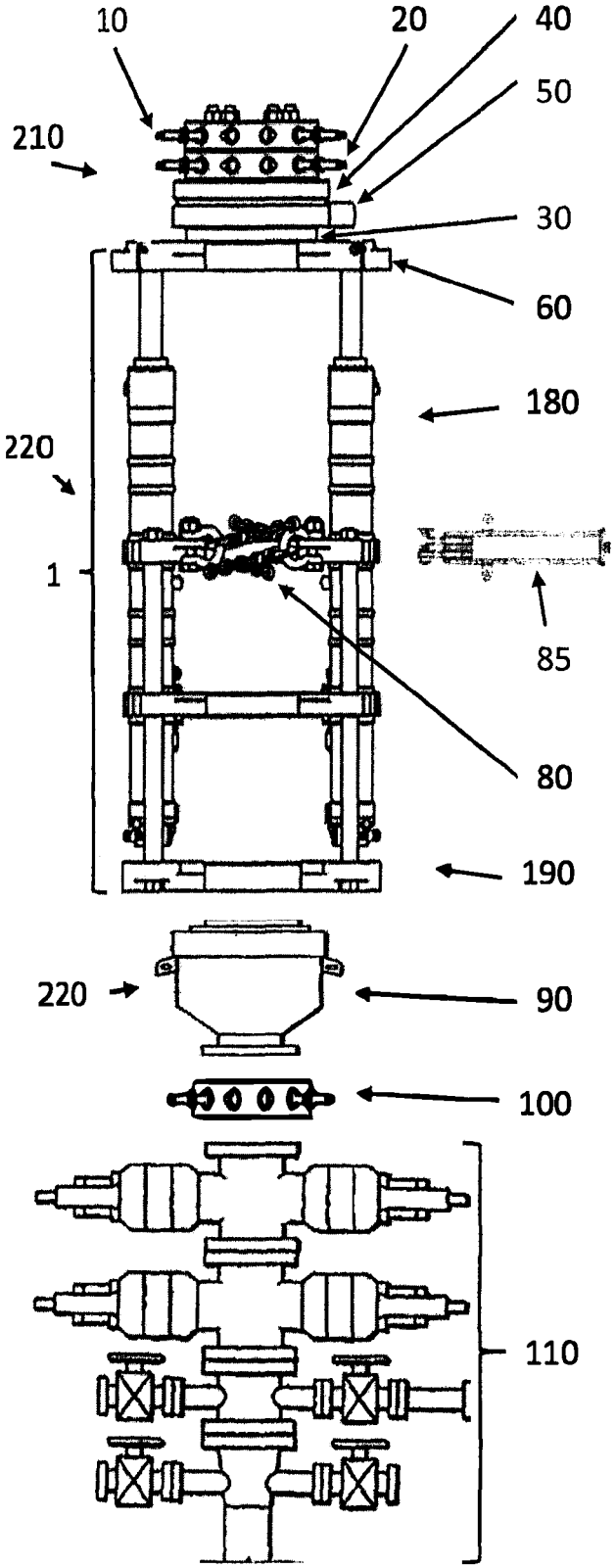
FIG. 6 shows a schematic (not to scale) representation of the elements of the invention installed at a wellhead of a well.

Apparatus—A description of the apparatus components and how they operate.

In a preferred embodiment, the apparatus of this invention includes a horseshoe jack 1 similar to the horseshoe jack of U.S. Pat. No. 9,945,191 attached to the annulus or similar top-hole equipment of a wellhead and mounted on a workover or similar drilling rig (not shown). At the top of the jack 1 on its travelling plate 60 is mounted a series of subassemblies, namely a travelling plate to rotary drive adapter 30 to the travelling plate 60, then to the other side of that adapter 30 is mounted the rotary drive assembly 50, to which another adapter plate, the rotary drive to hanger flange adapter 40 is attached. To that hanger flange adapter 40 a hanger flange 10 and a rotary hanger flange 20 are attached. A middle plate of the jack 1 may be attached to the drilling rig by chains 80 and rigid arms 85 to assist in resisting rotation of the jack and rotating assemblies when torque forces are generated by the rotary drive 50 and transmitted to tubulars captured in the rotary hanger flange during operation. The rotation of the rotary drive 50 may be by hydraulic motor or other means under operator control. In a preferred embodiment, the rotational torque should not exceed the torque-strength of the tubular being rotated. In operation, the inventors have found that rotational speed of 1-6 rpm, preferably around 4 rpm, is most suitable for use in cementing casing tubing into the bore of a larger casing being rehabilitated. Since the casing tubing being operated on is sitting or hanging from the wellhead's stationary flange 100, and does not need to be lifted out or injected into the wellbore any significant distance, the jack's stroke length can be very compact, in an embodiment around 4-6 feet. When rotational force is desired to manipulate the tubing captured in the hanger flange(s) of the device, the rotary drive is activated to turn the tubing in the wellbore. When a vertical or up-down linear movement is desired, the jack's linear piston drive mechanisms can be activated to provide in or out linear force to the tubing with respect to the wellbore.

When approaching a rig on a wellhead to work on tubing in the wellbore, the compact jack in a horseshoe configuration may be slid horizontally to envelop the tubular at the wellhead, and then attached to the wellhead. The flanges may then be affixed to the tubular where it extends out of the well, and rig operations may commence. Where cementing the tubular casing is to be accomplished, a cement head or swivel would be attached above the jack's flanges to the tubular's top end, and the tubular can then be rotated while cement is injected into the conduit of the tubing and back up the annulus between the casing tubing's external surface and the well's internal surface. At some point, a wiper plug can be injected pushed by salt water into the casing's internal bore, pushing concrete out and into the annulus while clearing and cleaning the bore to enable production therethrough after setting and completion. When cementing is completed, the jack's hanger flanges can be detached from the tubular, the chains and arms from the rig, and the jack from the wellhead, and the device can be moved horizontally from around the tubular and off the rig for transport to another job.

GLOSSARY OF TERMS AND DEFINITIONS

1 Horseshoe Jack Apparatus
10 Hanger Flange
20 Rotary Hanger Flange
30 Travelling Plate to Rotary Drive Adapter
40 Rotary Drive to Hanger Flange Adapter
50 Rotary Drive and Motor Assembly
60 Travelling Plate
70 Drive Motor for Rotary Assembly
80 Chain Restraints
85 Rigid Anti-rotation Arms
90 Wellhead Annular
100 Stationary Hanger Flange at Wellhead
110 Wellhead equipment (Pipe Rams, Blind Rams, Work Spool, Wellhead)
120 First subassembly
130 Lower jack assembly
140 Middle jack plate
160 Concentric circular driven portion
170 Rotary adapter plate
180 Means for hanger flange to be removably attached
190 First mount
210 Travelling second mount
220 Means for powering linear extension and retraction

The invention claimed is:

1. A compact rotary surface jack with a driven rotary hanger flange on an upper travelling plate of the jack, the jack comprising:

a. a first subassembly for providing vertical reciprocal motion to a casing tubular, first comprising:
   i. a lower jack assembly for mounting to a well-head attached to a blowout preventer or annular of a well bore, including a first mount for connecting the jack either directly or indirectly to the well-head, the first mount having a U-shaped passage through which the tubing or casing and any associated fittings fit;
   ii. at least one jack powered to both extend and retract thus lengthening and shortening a distance between the lower jack assembly and an upper end of the jack, the at least one jack being a linear jack with a first end and an upper second end, the first end being fixed to an upper side of the first mount;
   iii. a middle jack plate attached to the jack between the lower jack assembly and the upper end of the jack;
   iv. the upper travelling jack plate attached to the upper second end of the jack, the upper travelling jack plate including a travelling second mount having a U-shaped passage into and through which tubing or casing and any associated fittings fit;
   v. means for powering linear extension and retraction of the jack to alter the distance between the first and second mounts while the tubing or casing and any associated fittings are within the U-shaped passages of the mounts, said passages being in substantial vertical alignment and in working alignment with the well-head and associated well bore;
b. a second subassembly for providing rotational motion to the casing tubular, operatively attached to the upper travelling plate, the second subassembly comprising:
   i. a rotary drive fixed to the travelling plate with an internal passageway through which the casing tubular can fit, with a concentric circular driven portion of the rotary drive which is rotatable in relation to the jack on a plane normal to the direction of the jack's extension-retraction motion, but affixed to the rotary drive and jack to be driven to move vertically as the travelling plate is driven vertically by the jack;
   ii. the circular driven portion having a central passageway through which the casing tubular can fit;
   iii. a rotary adapter plate attached to the driven portion of the rotary drive, the rotary adapter plate having a central passageway through which the casing tubular can fit, the rotary adapter plate being removably affixed to the driven portion of the rotary drive;
   iv. at least one hanger flange attached to the rotary adapter plate having a central passageway through which the casing tubular can fit, with means for the hanger flange to be removably attached to and hold the casing tubular and transmit rotating movement of the rotary drive and linear movement of the jack to the casing tubular.

2. The compact rotary surface jack of claim 1 where bracing means are attached to the jack's middle jack plate, and the bracing means comprises:

a. chains or tension-bearing cables between the middle jack plate and an element of well-head equipment to assist in resisting rotational movement of the jack during operation; or
b. one or more solid extension arm elements between the middle jack plate and an element of wellhead equipment, to assist in resisting rotational movement of the jack and stabilize the rotating head in spatial relation to the well.

3. The compact rotary surface jack of claim 1 where the at least one hanger flange attached to the rotary adapter plate comprises:

a. a hanger flange for attachment to the casing tubing to hold the casing tubing from rotation relative to the flange when the apparatus operates to provide rotational motion to the tubing; and b. another hanger flange for attachment to the casing tubing to hold the casing tubing from linear movement relative to the flange when the jack of the apparatus operates to provide linear jacked movement to the tubing.

4. A process comprising the following steps:

a. moving a casing tubular a distance in a linear direction into and out of a wellbore to break frictional forces between a cement and an outer wall of the casing tubular with a compact rotary surface jack, while cementing the casing tubular into the wellbore, after the casing tubular has been injected into the wellbore, either during or after cement injection through the casing and into an annulus between the casing tubular's outer surface and an inner surface of the wellbore, and then b. rotating the casing tubular in the wellbore with the compact rotary surface jack, rotating the casing tubular in the wellbore while the tubular is in contact with the cement until the casing tubular and the cement are substantially bonded together and a substantially centralized location of the tubular in the wellbore is achieved; and c. then, disengaging and removing the compact rotary surface jack.

5. The process of claim 4, wherein after step c, the casing tubing is left suspended by a hanger from the wellhead, or is left without suspending the casing tubing tubular except by the cement's bond.

6. A compact rotary surface jack with a driven rotary hanger flange on an upper travelling plate of the jack, the jack comprising:

a. a first subassembly for providing vertical reciprocal motion to a casing tubular, first comprising:

i. a lower jack assembly for mounting to a well-head attached to a blowout preventer or annular of a well bore ii. at least one jack powered to both extend and retract thus lengthening and shortening a distance between the lower jack assembly and an upper end of the jack iii. a middle jack plate attached to the jack between the lower jack assembly and the upper end of the jack, the middle jack plate being attached to a bracing means, the bracing means including chains or tension-bearing cables between the middle jack plate and an element of well-head equipment to assist in resisting rotational movement of the jack during operation; or one or more solid extension arm elements between the middle jack plate and an element of wellhead equipment, to assist in resisting rotational movement of the jack and stabilize the rotating head in spatial relation to the well; and iv. the upper travelling jack plate attached to the upper end of the jack;

b. a second subassembly for providing rotational motion to the casing tubular, operatively attached to the upper travelling plate, the second subassembly comprising:

i. a rotary drive fixed to the travelling plate with an internal passageway through which the casing tubular can fit, with a concentric circular driven portion of the rotary drive which is rotatable in relation to the jack on a plane normal to the direction of the jack's extension-retraction motion, but affixed to the rotary drive and jack to be driven to move vertically as the travelling plate is driven vertically by the jack;

ii. the circular driven portion having a central passageway through which the casing tubular can fit;

iii. a rotary adapter plate attached to the driven portion of the rotary drive, the rotary adapter plate having a central passageway through which the casing tubular can fit, the rotary adapter plate being removably affixed to the driven portion of the rotary drive;

iv. at least one hanger flange attached to the rotary adapter plate having a central passageway through which the casing tubular can fit, with means for the hanger flange to be removably attached to and hold the casing tubular and transmit rotating movement of the rotary drive and linear movement of the jack to the casing tubular.

* * * * *